US006027002A

United States Patent [19]

Granger

[11] Patent Number: 6,027,002

[45] Date of Patent: Feb. 22, 2000

[54] PAPER TOWELLING DISPENSER WITH SPARE ROLL LOADING DEVICE

[76] Inventor: Maurice Granger, 17 rue Marcel Pagnol, 42270, Saint Priest en Jarez, France

[21] Appl. No.: 09/051,523

[22] PCT Filed: Jul. 17, 1996

[86] PCT No.: PCT/FR96/01110

§ 371 Date: Apr. 10, 1998

§ 102(e) Date: Apr. 10, 1998

[87] PCT Pub. No.: WO97/13440

PCT Pub. Date: Apr. 17, 1997

[30] Foreign Application Priority Data

Oct. 10, 1995 [FR] France ..... 95 12107

[51] Int. Cl.[7] ..... B26F 3/02; A47K 10/34; B65H 19/00

[52] U.S. Cl. ..... 225/35; 225/96; 225/106; 242/560.2; 83/334; 83/337; 312/34.8

[58] Field of Search ..... 242/559, 559.3, 242/560, 560.2; 312/34.8; 225/10, 16, 34, 39, 46–47, 96, 106; 83/334, 335, 337, 339, 660

[56] References Cited

U.S. PATENT DOCUMENTS

| | | | |
|---|---|---|---|
| 4,206,858 | 6/1980 | DeLuca et al. | 225/96 |
| 4,236,679 | 12/1980 | Jespersen | 242/55.53 |
| 4,487,375 | 12/1984 | Rasmussen et al. | 242/55.3 |
| 4,552,315 | 11/1985 | Granger | 242/55.3 |
| 4,621,755 | 11/1986 | Granger | 225/96 |
| 4,712,461 | 12/1987 | Rasmussen | 225/106 X |
| 4,732,306 | 3/1988 | Jesperson | 225/2 |
| 4,756,485 | 7/1988 | Bastian et al. | 242/55.3 |
| 4,844,361 | 7/1989 | Granger | 242/55.3 |
| 5,048,386 | 9/1991 | DeLuca et al. | 225/2 X |
| 5,441,189 | 8/1995 | Formon et al. | 225/2 |

FOREIGN PATENT DOCUMENTS

| | | |
|---|---|---|
| 0118624 | 12/1983 | European Pat. Off. . |
| 461732A2 | 3/1988 | European Pat. Off. . |
| 2332215 | 11/1975 | France . |
| 2703343 | 3/1993 | France . |

*Primary Examiner*—M. Rachuba
*Assistant Examiner*—T. Anthony Vaughn
*Attorney, Agent, or Firm*—Wall Marjama Bilinski & Burr

[57] ABSTRACT

A dispenser apparatus includes a loading device for sensing when an initial working roll of web material previously positioned in a receptacle is empty, so that it can be replaced with a fresh second roll positioned between a pair of flanges. The loading device includes a first mechanism fixed within a hinged cover of the apparatus including a movable tab in a position substantially opposite the point where the material web is inserted and placed on a drum. The device further includes a second mechanism extending from the apparatus housing which is activated when the cover is closed to sense when the initial roll is empty and to control the actuation of the mechanism to load the web from the fresh second roll.

10 Claims, 10 Drawing Sheets

FIG.12
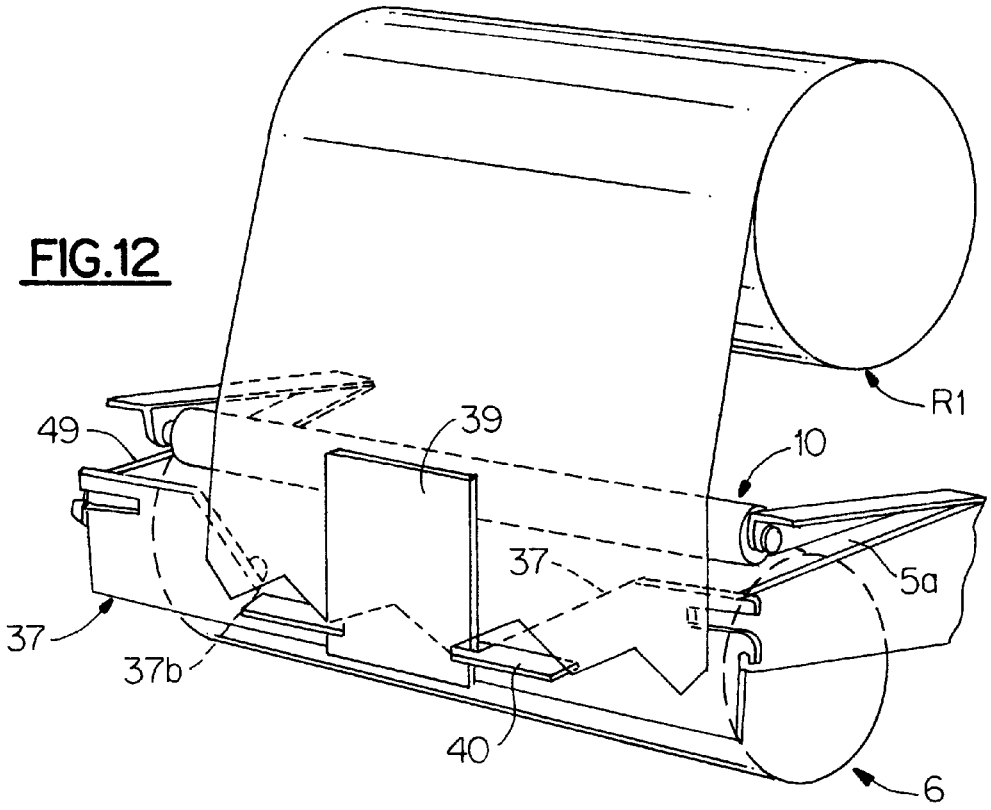
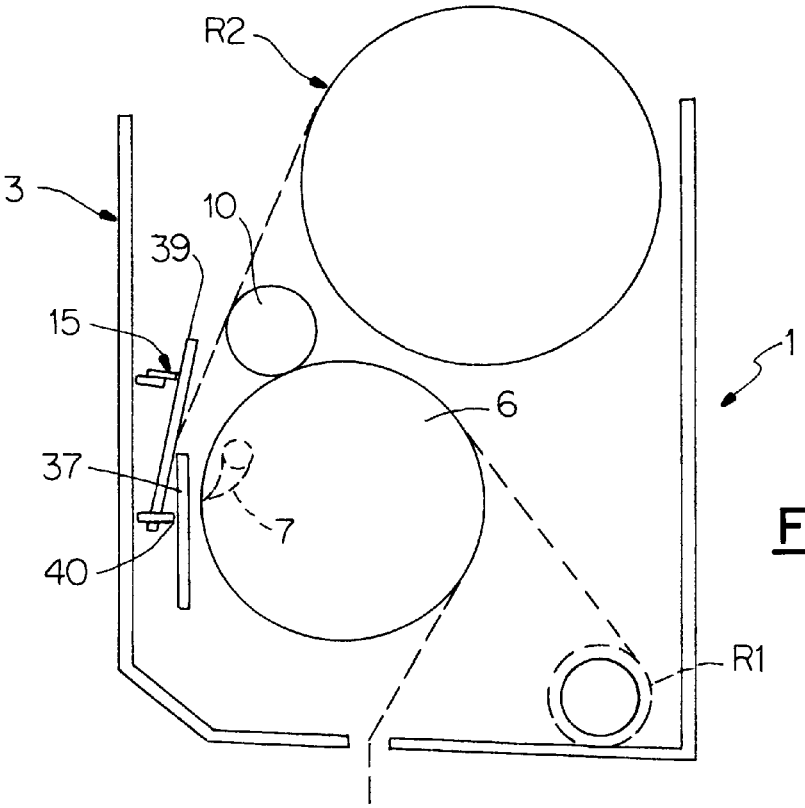
FIG.13

PAPER TOWELLING DISPENSER WITH SPARE ROLL LOADING DEVICE

BACKGROUND OF THE INVENTION

The invention relates to the technical class of towelling paper dispensers for hand towels, toilet, absorbent and similar paper or soft tissue-based products.

The invention relates to the same class when the dispenser is automatic or semi-automatic and uses pull-out flat, unfolded or folded paper band.

This type of equipment and dispensing apparatus is known to possess a spare roll that is installed in the dispenser before the service roll is depleted. Such spare rolls consist of paper wound onto a cardboard or other core and are horizontally installed in the dispenser.

Without engaging into a detailed description of possible dispenser component shapes, suffice it to say that this type of apparatus usually takes the shape of a U-shaped casing with a hinged, frontal lid that may be temporarily locked using a key, a latch or some similar device.

The lower part of the casing is arranged to be fitted crosswise with a drum that is equipped with a cutting device of suitable form that, when actuated, will penetrate into and cut the bands of material into the lengths desired.

A first roll, commonly called the service roll, is placed over the drum between support flanges that may or may not be articulated but are sufficiently flexible to receive and retain the roll.

A hold-down element fitted over the drum in the same axis between the sidewalls is pressed onto the drum. The paper band from the service roll is passed between the hold-down element and the drum in order to be guided by it, leaving the dispenser by its bottom part through a slit, at which point it may be seized by the user and pulled out.

It is easy to see that the diameter of the service paper roll in this type of dispenser is to be inspected regularly to see whether it is time to install the reserve roll.

Applicant has designed rod-operated transfer mechanisms for moving the spare roll from its position over the service roll into the dispensing position, replacing the latter when depleted. Such mechanisms, though reliable, remain complex and costly to manufacture.

According to the prior art, there is also the possibility of using counter-rotating pinion pairs to place the spare roll into operation. Such mechanisms are likewise costly and not practical to install.

The object of the invention is to design and make a simple system that would be cheap to manufacture and would make loading spare rolls easy.

A further object of the invention is to offer a solution that could be used with automatic and semi-automatic dispensers of folded and non-folded paper.

These and other objects will become apparent from the following description.

According to a first aspect of the invention, the towelling paper dispenser for hand towels, toilet, absorbent and similar paper, whether automatic or semi-automatic and using pull-out, unfolded or folded paper band comprising a casing with a hinged, frontal cover, said casing having two support flanges perpendicular to the casing backwall, with a drum and an integral cutting device installed crosswise in the bottom part of the casing between said flanges, said drum being rotated by paper traction and a separate hold-down element fitted over the drum being held in place between the flanges of the casing, the lower part of which is slotted for the paper to pass and the paper roll being held in place between the formed upper flanges and a receptacle being provided in the bottom rear of the dispenser, is remarkable in that it comprises a loading system designed to test for depletion of the first or service roll in the receptacle so as to switch to a so-called "reserve" or spare roll located between the flanges, and in that the loading system comprises a primary device mounted inside the cover in a position substantially facing the paper band as it passes and is run onto the drum to cut it as well as a secondary and complementary device mounted to the dispenser casing, said secondary device being cocked by the closing of the cover so as to test for the depletion of the first roll, in which case it causes the primary device on the cover to feed the band of paper from the so-called "reserve" roll onto the drum.

According to another aspect, the nearly depleted service roll in the receptacle being in the dispensing position with the paper band placed on the drum and ready to be cut, it can be seen that the band is stretched and constitutes a guard area adjacent to a profiled plate placed crosswise behind the drum, said guard band under certain conditions being in a position to cooperate with the secondary device of the loading system.

These aspects and others will become apparent from the following description.

BRIEF DESCRIPTION OF THE DRAWINGS

The object of the present invention is described, merely by way of example, in the accompanying drawings in which:

FIG. 12 is a perspective view of an alternative embodiment of the hold-down element designed to press down on the paper from the top roll for loading.

FIG. 13 is a cross-sectional view along the line B—B of FIG. 12.

DETAILED DESCRIPTION OF THE INVENTION

Figure 1:
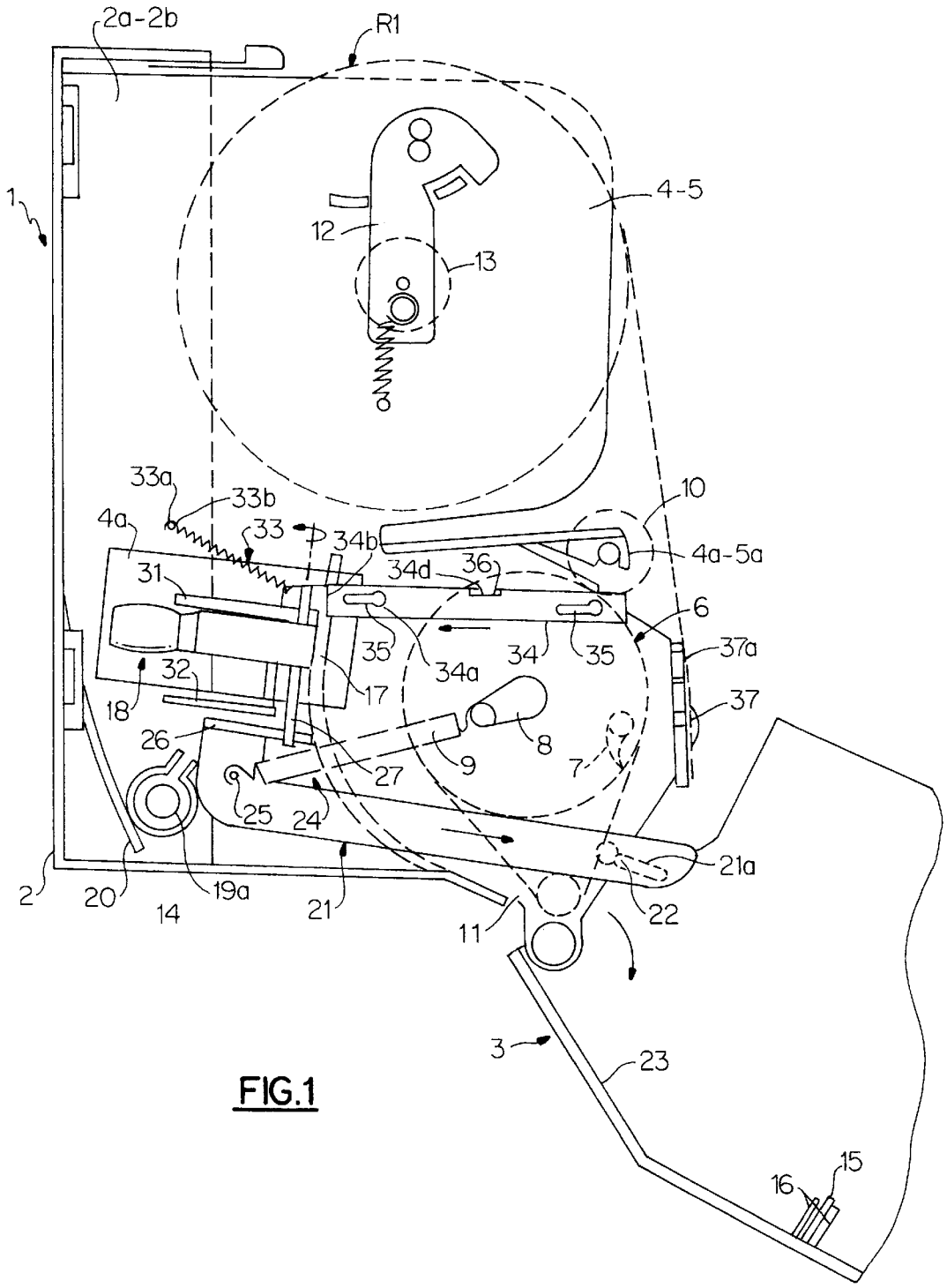
FIG. 1 is a cross-sectional view of the dispenser with open cover and a fresh service roll, offering a schematic view of the main components and the invention.

In order that the present invention may more readily be understood, the following description is given, merely by way of example, reference being made to the accompanying drawings.

The towelling paper dispenser is identified in its entirety by reference number 1. The apparatus is designed for the automatic or semi-automatic dispensing of hand towels, toilet paper, absorbent paper and similar paper of any material. The dispenser (1) may be laid out as disclosed in the various patents in the name of applicant to dispense flat, i.e. non-folded, or folded paper.

The dispenser (1) shown comprises a casing (2) made of a plastic or other material and a hinged cover (3) of a similar material. The casing (2) has two outer sidewalls (2*a*–2*b*) and two support flanges (4–5) perpendicular to the casing backwall and clicked in place or mounted in another, suitable manner onto the casing (2) bottom. Within the casing and mounted crosswise between the flanges (4, 5) there is a drum (6) with an integral cutting device (7) which may, solely by way of example, operate as disclosed in French patent No 2.332.215.

The drum (6) may be of any suitable design. It is rotated by traction when the user pulls on the paper band, thus actuating an eccentric crank (8) controlled by a spring (9) hooked to one of the casing supports (4).

A separate hold-down element (10) is fitted within two notches (4*a*, 5*a*) separately formed in each support flange (4, 5) and positioned over the drum (6). The hold-down element (10) presses down crosswise on the drum and in the same axial plane.

The bottom part of the casing (2) is provided with a horizontal slit (11) through which the paper band is passed out of the dispenser (1) for the user to seize.

Roll (R1) is retained by the pivoting flanges (12) which are provided with studs (13) designed to snap into the core of the roll under consideration.

These various parts and devices having been identified, we shall now identify and describe the loading device according to the present invention.

This device is designed to be operated when the service roll (R1) is nearly depleted, i.e., in comparison with its initial diameter there remain only a few lengths of paper to be dispensed. At this point, the nearly depleted roll has to be moved by the serviceman and placed in the bottom and rear part of the dispenser (1) arranged to act as a receptacle (14) as shown for example in FIG. 6. Another roll, called a reserve roll (R2) is now installed.

The loading system according to the invention tests whether the service roll (R1) is depleted and initiates the loading stage of the fresh roll (R2).

The loading system, then, comprises the primary device mounted on the inside of the cover (3), substantially facing the gap (e1) between the drum and the hold-down element (10) where the paper band passes and is introduced, and a secondary, complementary device on the dispenser casing (2). The latter device is designed to detect the depletion of roll (R1) and to actuate the primary device inside the cover.

The aspects of these various devices are described in more detail, reference being made to the accompanying drawings.

The cover (3) is fitted with a horizontal, oblong, movable tab (15) along its length, which is a sliding fit between the two parallel lugs (16) fixed to the cover and a linking bar (16*a*). The tab (15) is free to protrude beyond the lugs (16) where the cover (3) angles inward. Indeed, the tab (15) is located near one of the inside ends of the cover (3) to face the complementary mechanisms mounted onto the casing (2). One end of the tab (15) is heel-shaped (15*a*) and will be actuated as explained hereunder. The end (15*c*) opposite the heel shaped end (15*a*) can move toward the area where the paper band from the reserve roll (R2) is fed between the drum and the hold-down element (10).

Figure 5:
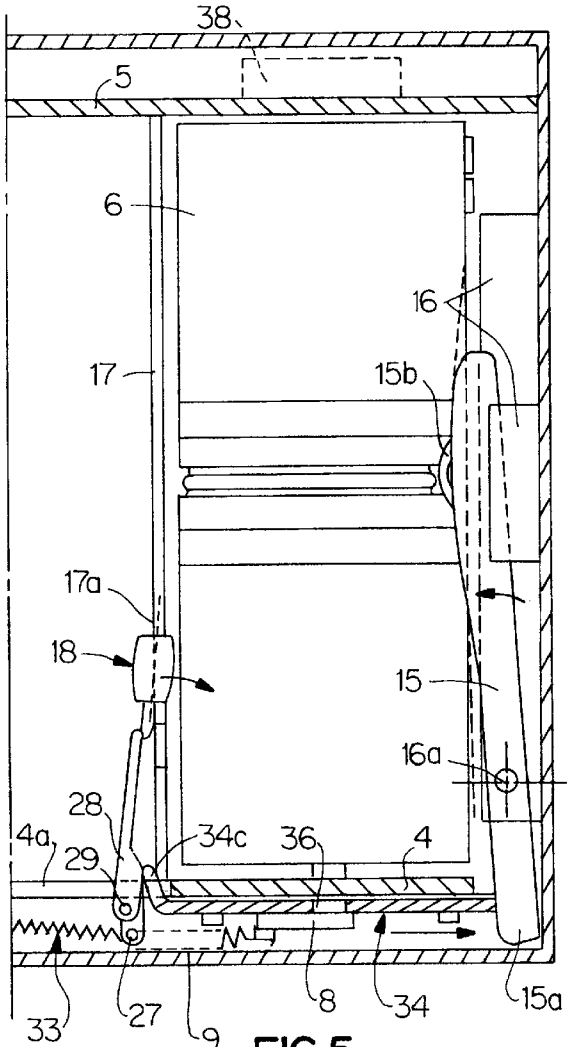
FIG. 5 is a cross-sectional top view along the line A—A of FIG. 4.
Figure 3:
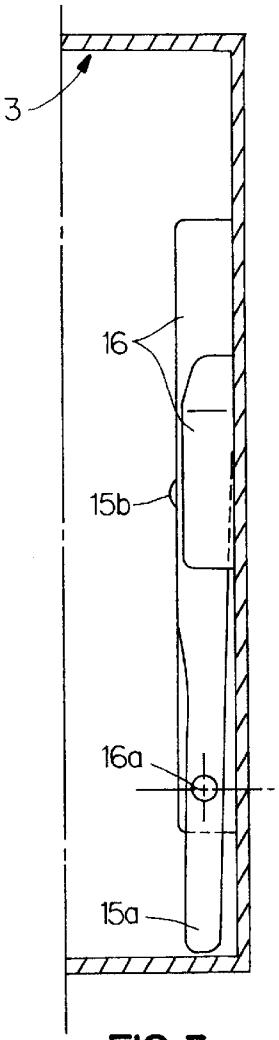
FIG. 3 is a partial plane view of the cover-mounted device shown in FIG. 2 shown at rest.

As shown in FIGS. 3 and 5, the tab (15) includes a protrusion (15*b*) that, facilitates loading of the drum (6) by engaging a groove (not shown) in the central part of the drum.

The casing (2), with the exception of the main components described previously, is laid out as follows.

Across the casing (2) and between the backwall (1*a*) and the drum (6) there is fitted a curvilinear, profiled plate (17) substantially matching the curve of the drum and leaving a gap (e2) for the paper band to pass while being pulled out through the lower part of the casing.

Said plate (17) is provided with a hole (17*a*) near one of its sides for the passage of a probe (18).

Said plate (17) closes off the spent roll (R1) area or receptacle on the bottom of the casing (2) while acting as a guide for the paper from said roll. The area acting as a receptacle (14) for the spent roll (R1) is advantageously laid out with, reckoned from the flanges (4–5), protruding tabs for retaining purposes with disc-shaped ends (19*a*) to partially penetrate the core of roll R1. The lower part of the casing bottom is provided with inwardly protruding, flexible tabs (20) designed to rest on said roll (R1) providing, together with the discs (19*a*) referred to above, a braking action when the paper band is pulled out, allowing the paper to be separated from the core.

The secondary mechanism operates as follows. Probe (18) is mounted onto a hinged lever (21) that moves alongside the support flange. The lever (21) has an oblong slot (21*a*) near its front end in which runs a stud (22) fixed to the flange (4). The lever (21) can move backwards when rebounding on pushing means (23) which, in practice, is the inwardly sloping section of the cover (3). Said lever (21) is pulled back by a spring (24), one end of which (24*a*) is attached to the crank (8) actuating the drum, the other end (24*b*) being attached to a fixed point (25) on the rear of the lever. Said spring (24), advantageously, rotates the drum (6).

The rear (21*b*) of the lever is arranged to receive a horizontal pad (26) provided with an oblong slot (26*a*) in which runs a pin (27) for the test probe (18) to pivot on. Said pin (27) is axially and vertically placed in a support (28) formed at the end of the probe (18). The support (28) pivots on the pins (29–30) in the profiled parallel tabs (31–32) on the flange (4) against a second pull-back spring (33), one end (33*a*) of which is attached to the rear of a fixed point (33*b*) of the support flange (4). The test probe (18) thus pivots and traverses a profiled hole (4*a*) in the facing flange (4), approaching as it does the cross-plate (17) behind the drum and traversing it in certain stages of operation to approach the drum when the lever (21) is actuated as will be shown hereinafter.

The support (28) described previously is an oblong part and the pins, or one end of the same through-pin, which is fastened to the lever, the other end being attached to the secondary pull-back spring, is/are located at the rightmost side. The lever, when actuated, will swing the support (28) through a circular arc, causing the test probe to pivot radially by more than 90°.

In addition and along the exterior of the flanges (4), there is a slide (34), which is a strip with two oblong slots (34*a*) through which pass the pins (35) mounted onto the flanges (4) to guide the slide and act as a stroke limiter. The rear end of the slide (34*b*) is a hook (34*c*) facing the test probe as it swings full-circle. Said slide (34) is substantially horizontal, whereas its front (34*c*) is located substantially such as to face the movable tab on the cover. Said slide is provided with a notch (34*d*) for a stop pin (36) to limit the travel of said slide.

In addition, and according to the invention, there is a supplementary plate (37) in the front part of the dispenser designed, as will become clear hereinafter, to guide the first band of paper from the reserve roll (R2) into its preliminary position. Said plate (37) is clicked in place (37*a*) between the side flanges (4–5) of the casing.

The general principle of operation of the dispenser and that of the loading system in particular will be discussed hereinafter, reference being made to the accompanying drawings, it being understood that the structural elements of the cutting device cylinder may vary.

Figure 2:
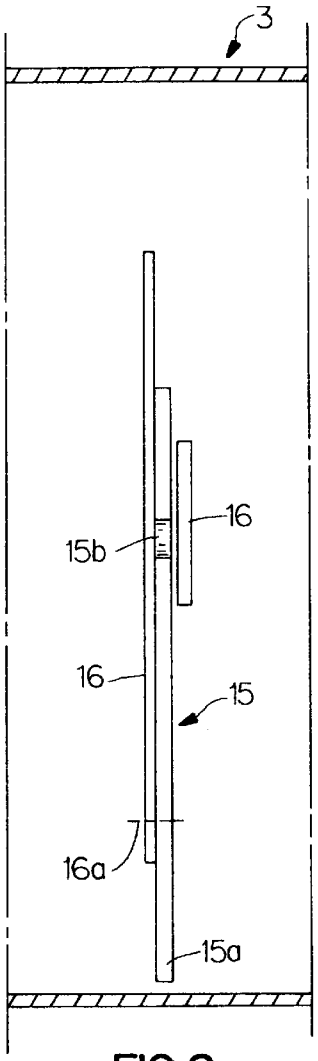
FIG. 2 is a partial, large-scale view of one of the loading devices mounted onto the cover. According to this view, the device referred to is shown along a line indicated by the arrow F1 of FIG. 1.

Looking at FIGS. 1 through 3, it can be seen that the dispenser contains a service roll (R1), whose paper band unrolls down to the matching plate (37) in the frontal part of the apparatus.

Figure 4:
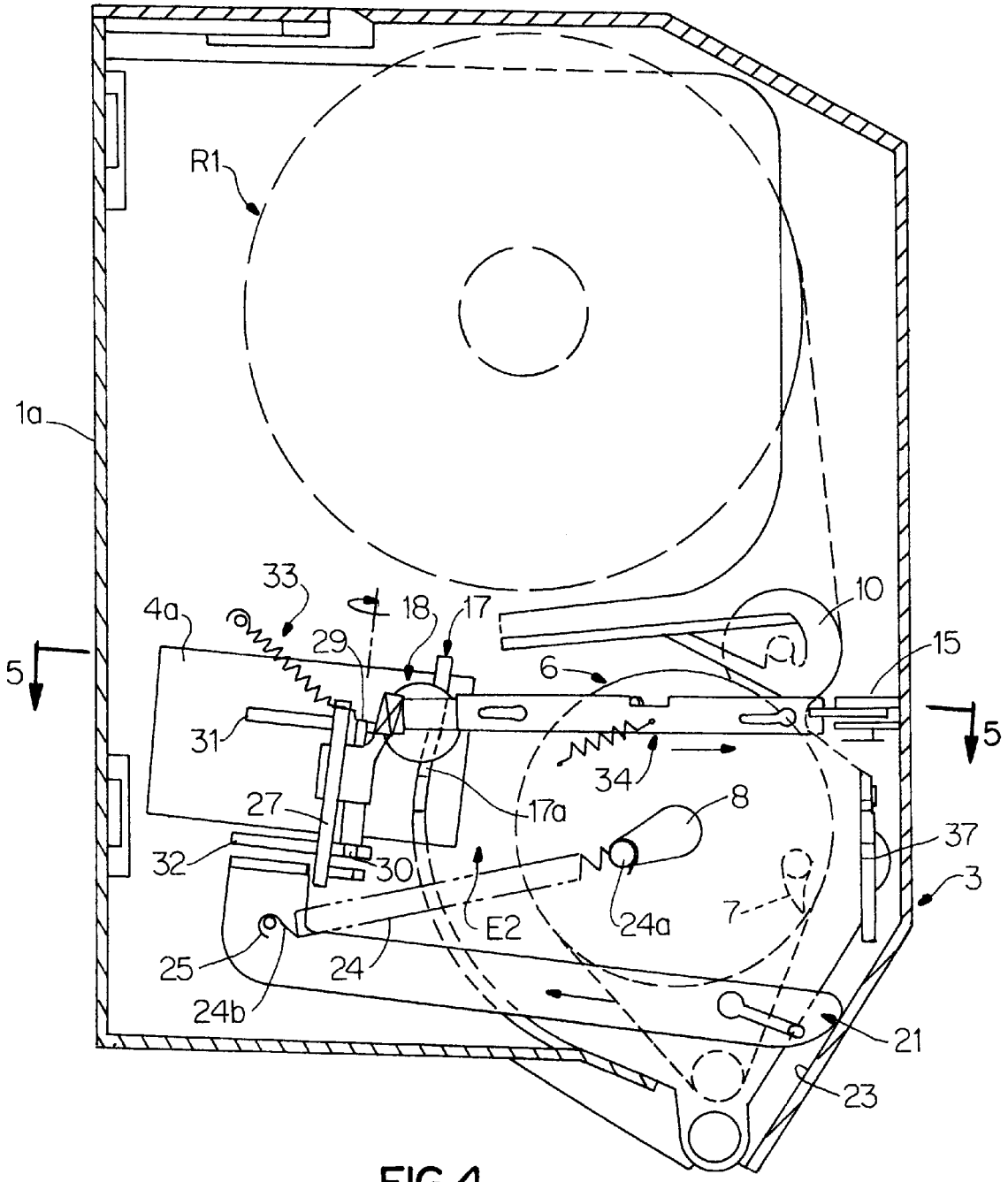
FIG. 4 is similar to FIG. 1 but shown with the cover closed and locked with the paper from the service roll in the loading position.

When the cover is closed (FIGS. 4 and 5), its bottom part (23), angling inwards and adjacent to the opening, will exert an increasing pressure on the lever (21) in the casing (2). The lever (21) is thus pushed backward, causing the hinged test probe (18) to pivot and substantially enter into the slot provided in the cross-plate (17) of the casing behind the drum. The test probe (18), which is free to move, simultaneously pushes the slide (34) forward along the length of the flange (4). The movement thus generated will in turn cause the slide front end to push the heel shaped end (15*a*) of the cover tab (15). This causes the tab (15) to rotate and its opposite end (15*c*) will load the paper band located in front of the front plate of the apparatus between the drum (6) and the hold-down element (10). The drum (6) is set into motion in a known manner by actuating a knob (38) located at the opposite end of the drum shaft and will, with no difficulty, cause a length of paper matching the circumference of the drum (6) to be transported a single turn before it is severed by the cutting device in a known manner.

The dispenser (1) remains in this state until the paper roll needs replacement and a serviceman realizes that the service roll (R1) is depleted. A fresh service roll (R2) will then have to be installed.

Figure 6:
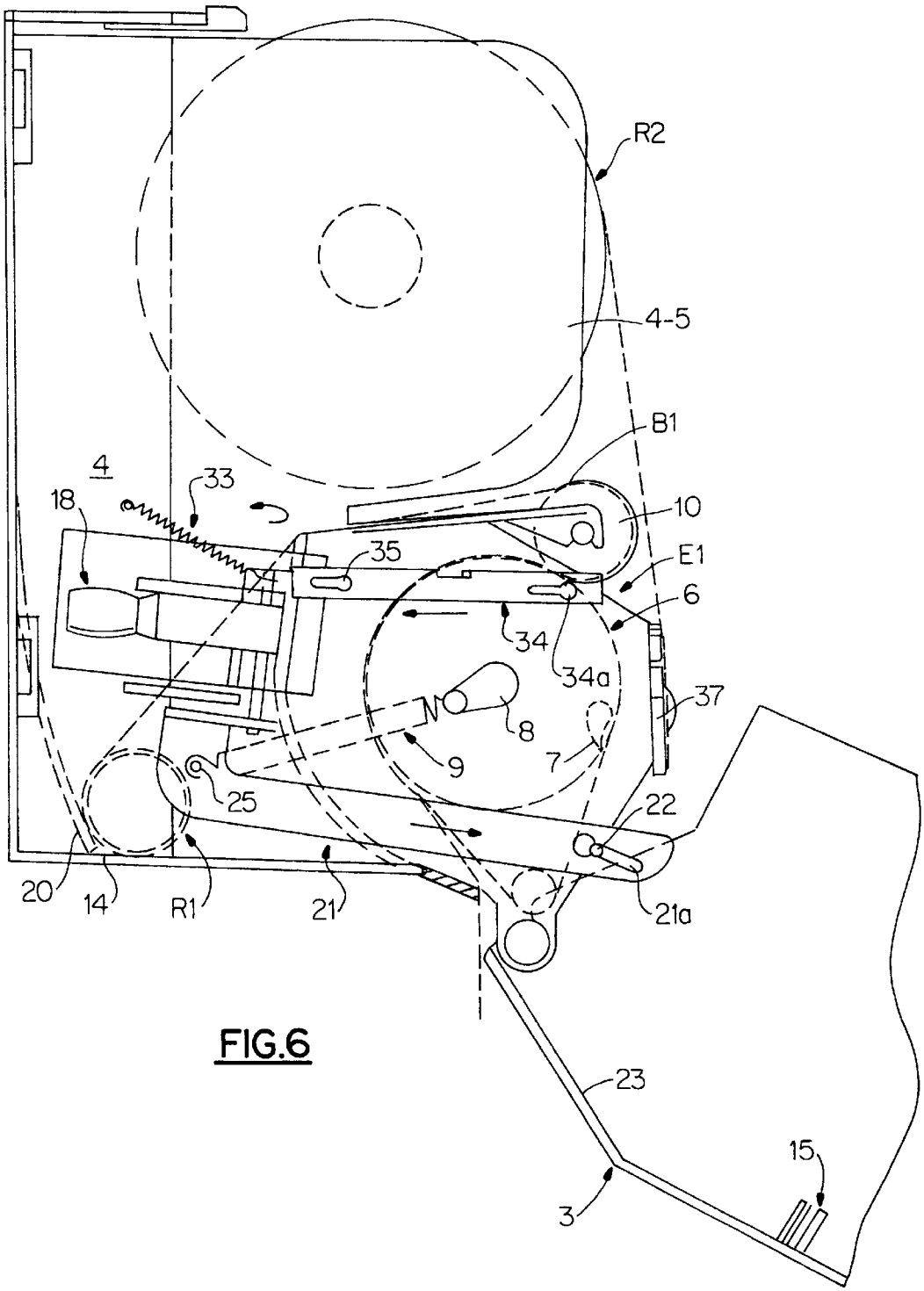
FIG. 6 is similar to FIG. 1 with open cover and the first or service roll moved into the bottom rear section of the dispenser, ready to be unrolled to the end and with a fresh spare roll being installed by the serviceman to replace the first service roll.

It is clear from FIG. 6 and the drawings following it that, when the serviceman opens the cover (3), the lever (21) and the slide (34) will be freed, moving the test probe (18) into its initial, drawn-back position. The serviceman places spent roll (R1) in the receptacle (14) in the rear of the dispenser. The roll core will be retained by the disc-type tabs on the flanges (4–5) of the casing (2). Paper roll (R1), under the circumstances, will nevertheless continue to supply the drum (6) and its associated cutting device. Between the drum pressure and contact area and the hold-down element (10) and the nearly spent service roll R1 in the receptacle there now appears a paper band B1 that is run behind the cross-plate of the casing, closing off the slot therein. The serviceman places a fresh roll of paper between the flanges and the upper studs of the dispenser, pulling the end of the paper band in front of the front plate of the apparatus (FIG. 6).

Figure 7:
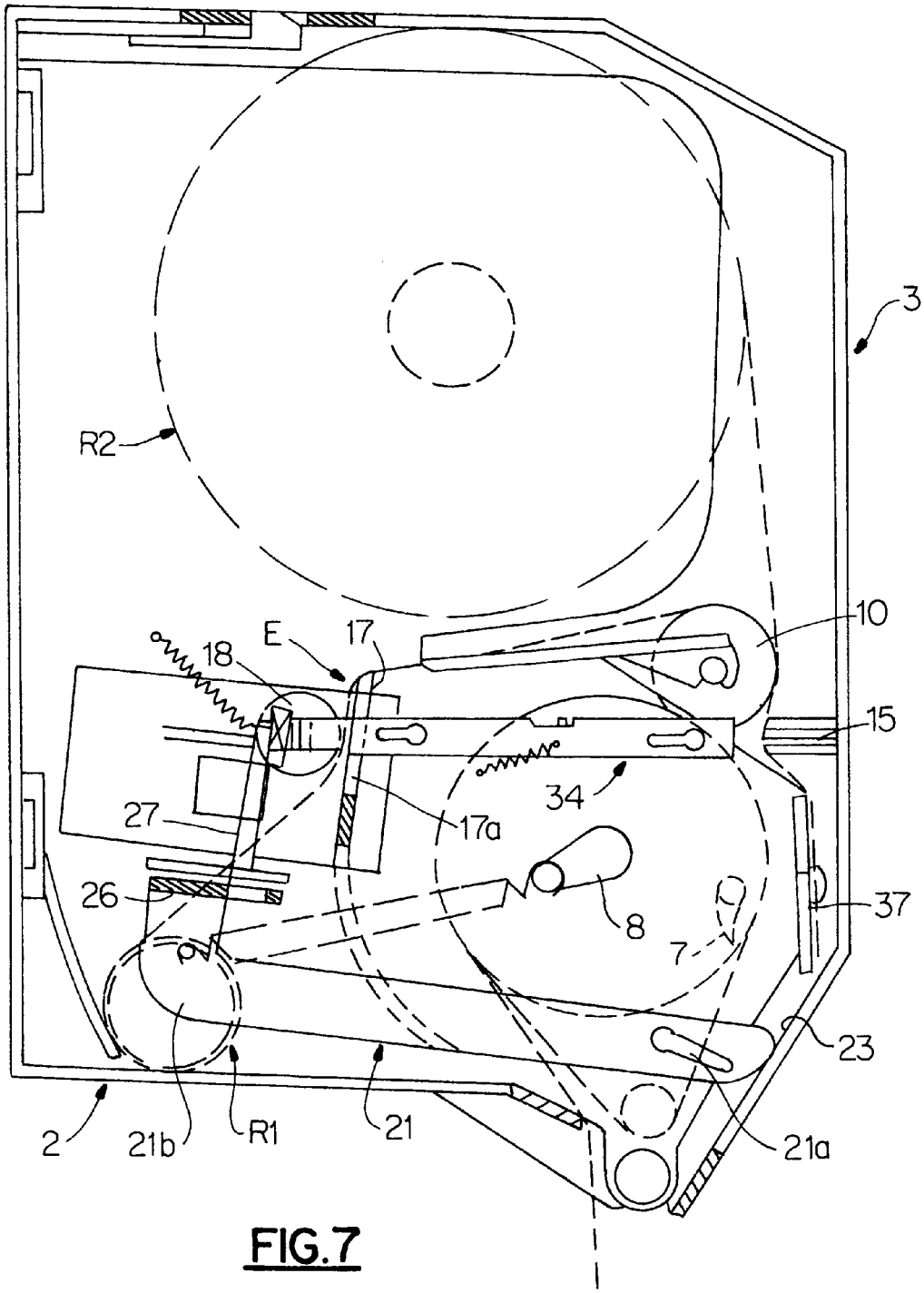
FIG. 7, complementary to FIG. 6, shows the dispenser with its cover closed but the paper band of the fresh roll is not now in the loading position.
Figure 8:
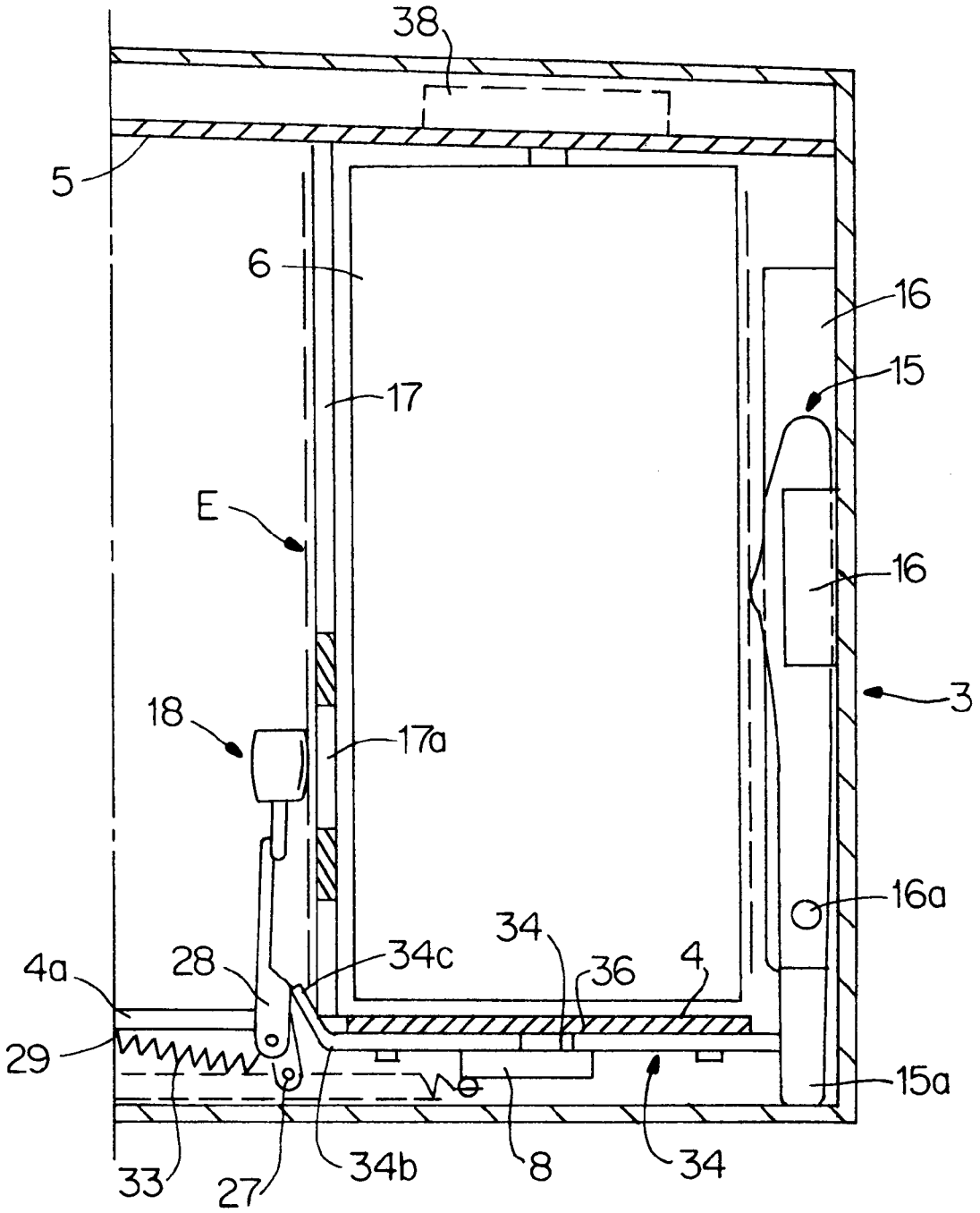
FIG. 8 is a cross-sectional top view along the line B—B of FIG. 7.

The next step, shown in FIGS. 7 and 8, is to close the cover (3). This causes a similar backward translation of the lever (21), causing the test probe (18) to pivot anew. In this situation, the paper band from the nearly spent roll (R1) acts as a guard (E), limiting motion and preventing the test probe (18) from entering the slot of the plate. The paper band is tightened by the pressure exerted by the drum (6) and the hold-down element (10) on the one hand and by the braking effect imparted by the shape of the receptacle containing roll (R1) on the other. Under the circumstances, the test probe (18), which has been prevented from pivoting completely because of the retaining action of the guard referred to previously, cannot touch and push the slide (34). The slide (34), therefore, cannot act upon the loading tab on the cover (3) and paper can only be withdrawn from the first roll.

Figure 9:
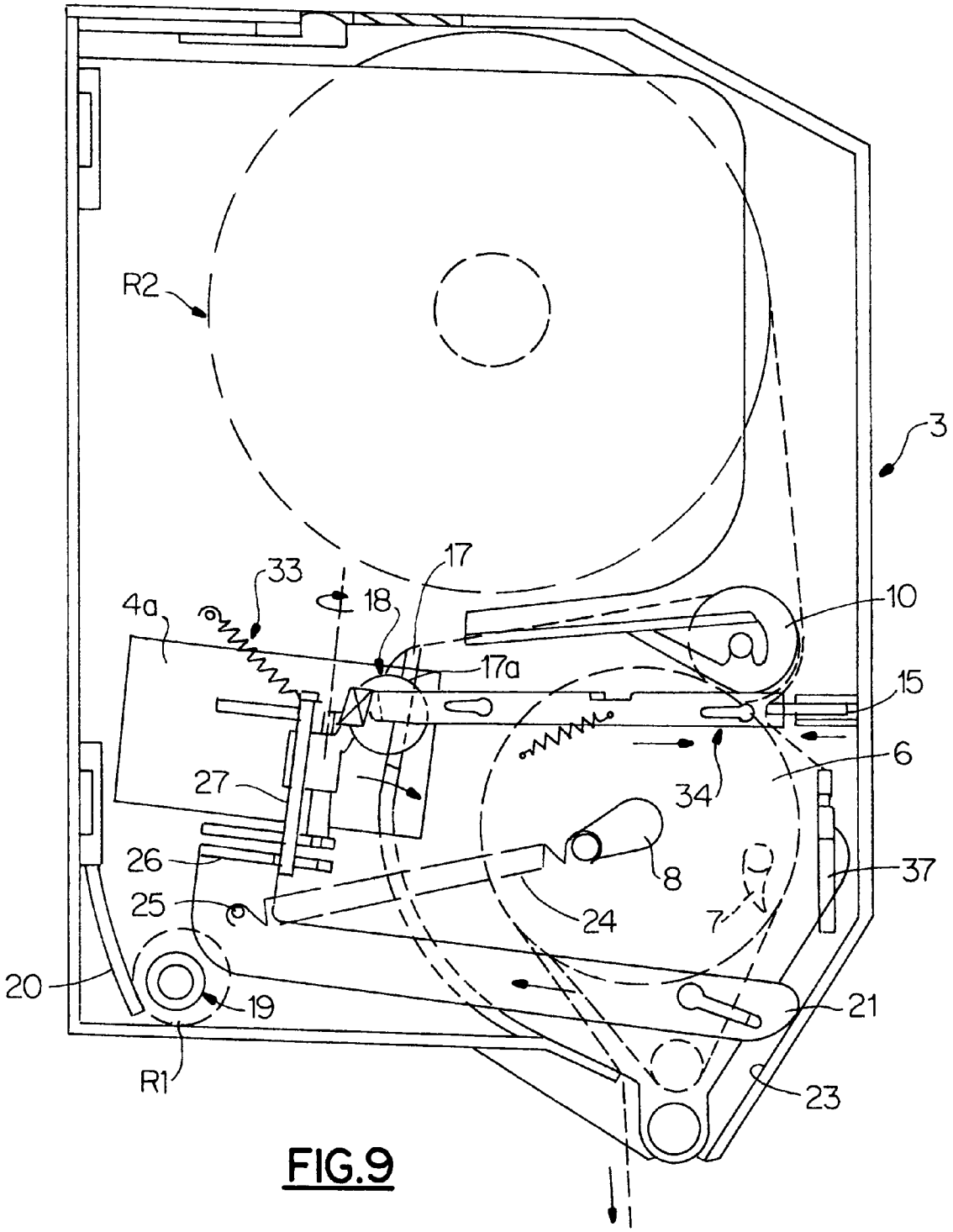
FIG. 9 is similar to FIG. 7 but with the paper from the fresh roll in the loading position.
Figure 10:
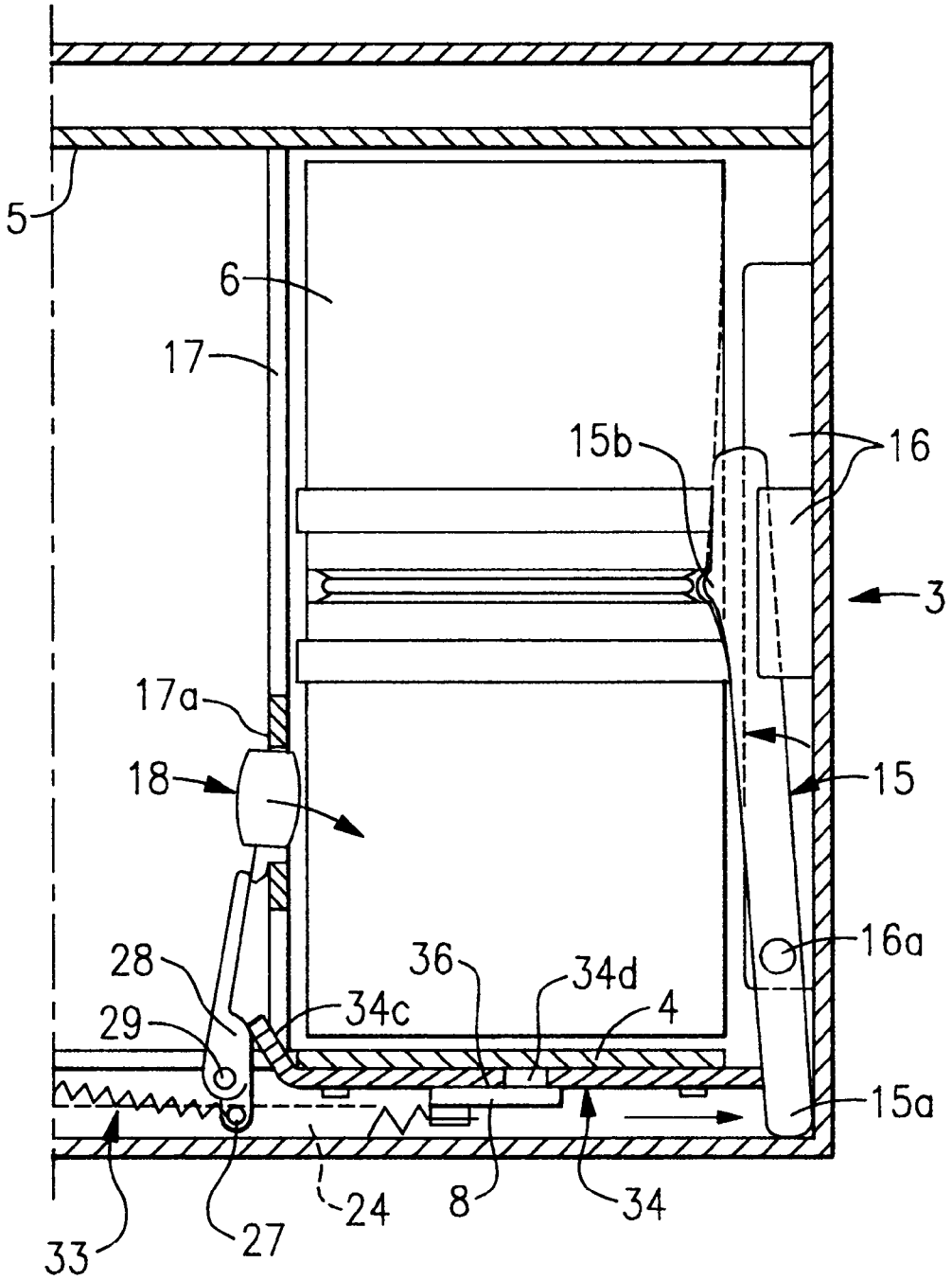
FIG. 10 is a partial cross-sectional top view along line C—C of FIG. 9.
Figure 11:
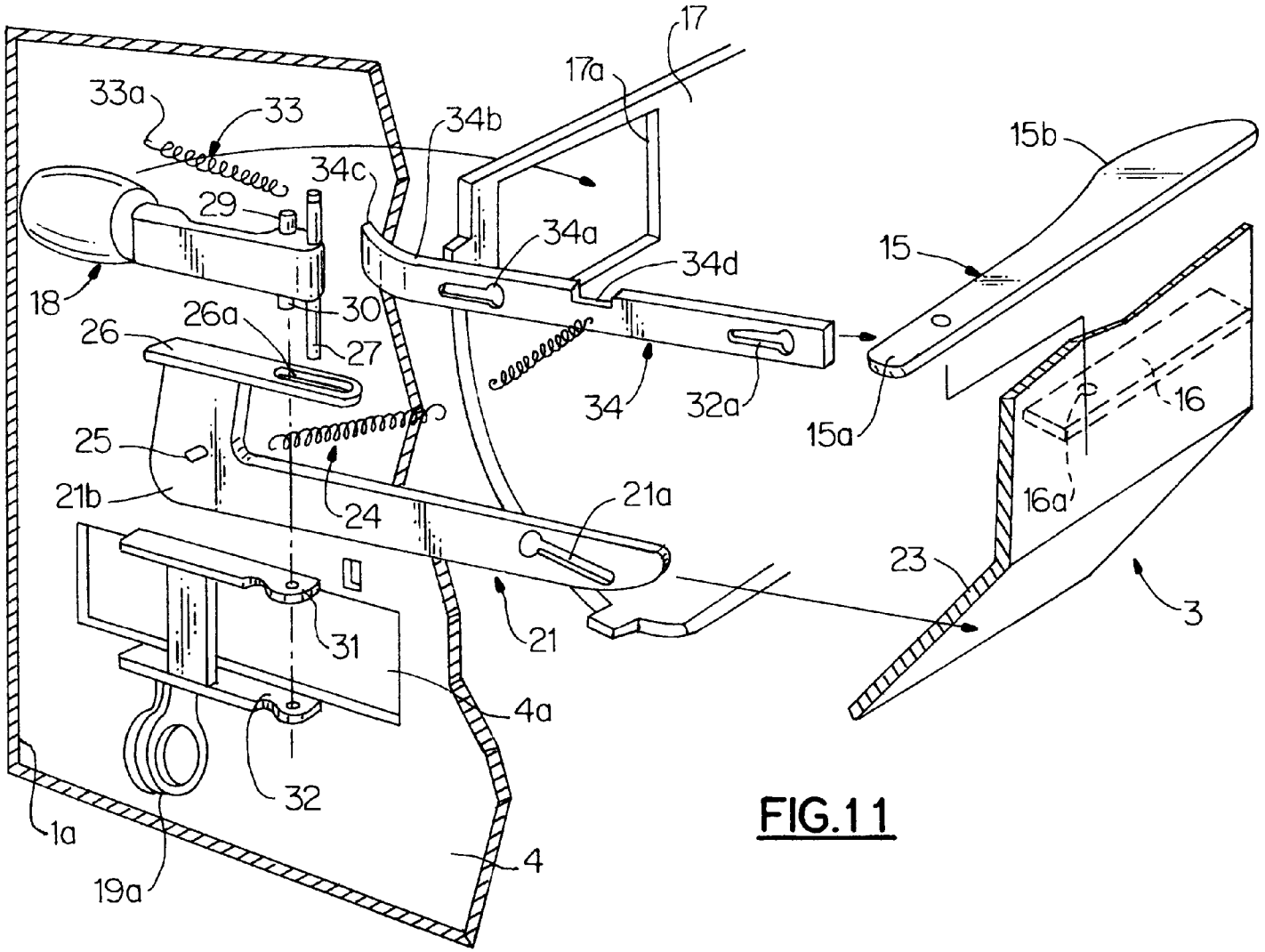
FIG. 11 is a partial, large-scale exploded view of the loading system.

Looking at FIGS. 9 and 10, it can be seen that when roll R1 is fully spent, the guard disappears with the last length of paper and the test probe (18) is freed for want of counter-pressure. The probe (18) now penetrates the hole provided in the cross-plate and, pivoting completely, pushes the slide (34) forward, which touches the cover tab. The latter, moved by the heel, will be positioned in the gap between the drum (6) and the hold-down element (10), causing the paper from the following roll to be moved in position, and the cycle can start anew.

FIGS. 12 and 13 show an alternative embodiment of the devices allowing the paper from the top reserve roll to be loaded. In this case, the front plate top edge (37) is recessed (37*b*) for a rectangular plate (39) to pass and swing. Said plate is placed and hinged on a base (40) which is part of plate (37). In this configuration cover tab (15), when actuated, will cause plate (37) to press down on the drum, it being understood that the paper band will have been loaded, as is shown in FIG. 13, between the plate and the drum. The arrangement improves performance and provides better distribution of tab pressure. The base (40), in addition, will locate the paper band.

The benefits of the invention are clear, especially as regards the simplified installation of dispenser component parts and loading device. The loading device, as has been shown, is operable regardless of automatic or semi-automatic paper dispensing mode and irrespective of whether the paper is folded or not. In the latter case a cross bar is mounted as disclosed in applicant's previous patents.

We claim:

1. A paper dispenser for dispensing metered amounts of a paper web material, said dispenser comprising:

a casing including a hinged front cover and a pair of support flanges perpendicularly disposed relative to a casing backwall;

a rotatable drum;

an integral cutting device, said cutting device and said drum being installed crosswise in a bottom part of said casing between said support flanges, said drum being rotated by traction of paper web material;

a hold-down element fitted over said rotatable drum, wherein the part of said casing is slotted to enable the paper web material to pass therethrough, said casing including a receptacle in the rear of the lower part thereof sized for retaining a first service paper roll and a second reserve paper roll supported by a pair of flanges in an upper part of said casing;

a loading system designed to test for depletion of the first paper roll placed in said receptacle so as to switch to said second paper roll located between said upper flanges, said loading system including a primary mechanism mounted inside said cover in a position substantially facing a paper band from the first paper roll as the band passes and is run onto the drum to cut said band, and a secondary mechanism mounted to said dispenser casing, said secondary mechanism including a member which is engaged by the closing of said cover into a position which tests for the depletion of said first paper roll to cause said primary mechanism on the cover to feed a band of paper from the second paper roll onto the drum;

wherein the paper band of the nearly depleted first paper roll disposed in said receptacle placed on the drum is stretched and constitutes a guard area adjacent to a profiled plate placed crosswise behind said rotatable drum, said paper band being disposed to cooperate with said secondary mechanism of said loading system, said profiled plate including a hole for receiving said member of said secondary mechanism when the cover is closed.

2. A dispenser as recited in claim 1, wherein the receptacle includes devices cooperating with said first roll to produce a braking counter pressure when the paper band is pulled out.

3. A dispenser as recited in claim 1, wherein the primary mechanism includes a horizontal, oblong, movable tab pivotally attached between parallel lugs fixed to said cover, said tab including a substantially heel-shaped end which is free to protrude beyond the lugs, said movable tab having an opposite end which is pivotally movable toward the area where a paper band from the second paper roll is fed between the drum and the hold-down element.

4. A dispenser as recited in claim 3, wherein the movable tab includes a protrusion which, when moved, faces the central part of said drum to facilitate loading.

5. A dispenser as recited in claim 1, wherein said secondary mechanism is mounted to said casing next to one of said support flanges and includes an articulated pivoting test probe located behind said drum and said profiled plate, said secondary mechanism being articulated and pivoting on said support flange and being actuated by a profiled lever which is pushed backward by a pushing device defined by part of said cover, said test probe being moved to a retracted position toward said flange when the cover is open and to a position which is at least substantially perpendicular to said flange when the cover is closed, said probe being engageable with said hole of said profiled plate when said cover is closed, said secondary mechanism further including a substantially horizontal slide disposed along the exterior of said flange, said slide being actuatable by said test probe when said test probe pivots, causing said slide to press against a tab of said primary device when said test probe is not hindered by the paper band from the first paper roll disposed in said receptacle, allowing said test probe to pass through the hole in the profiled plate.

6. A dispenser as recited in claim 5, wherein the lever is biased by a spring attached at one end to a fixed point on the rear of said lever, an opposite end of said spring being attached to a crank actuating said drum.

7. A dispenser as recited in claim 5, wherein the rear of said lever is arranged to receive a horizontal pad, said pad having a hole in which runs a hinge pin traversing a support part mounted on the test probe, said support part being pivotable on a fixed part formed on one of said support flanges.

8. A dispenser as recited in claim 7, wherein said slide is guidingly supported on said support flange, the rear end of said slide having a hook for engaging said test probe, the front end of said slide cooperating with said tab of said primary mechanism, said tab including a substantially heel-shaped end which cooperates with said front end.

9. A dispenser as recited in claim 1, including a plate disposed in a front part of the dispenser, said plate being profiled to guide the band of paper from said second roll into a preliminary position relative to said drum, said plate being disposed between said support flanges.

10. A dispenser as recited in claim 9, wherein said front plate includes a top edge which is recessed and has a base for positioning and hingably supporting a paper guide, said paper guide being actuated by a tab of said primary mechanism to load the paper band from said second roll onto said drum.

* * * * *